United States Patent [19]

Hall

[11] Patent Number: 4,934,108

[45] Date of Patent: Jun. 19, 1990

[54] VENEER LATHE KNIFE HONING DEVICE

[75] Inventor: Doyle J. Hall, Springfield, Oreg.

[73] Assignee: Doyle's Tool and Gauge Co., Springfield, Oreg.

[21] Appl. No.: 346,625

[22] Filed: May 2, 1989

Related U.S. Application Data

[63] Continuation-in-part of Ser. No. 100,247, Sep. 23, 1987, abandoned.

[51] Int. Cl.[5] ..... B24B 3/38

[52] U.S. Cl. ..... 51/205 WG; 51/170 PT; 51/208; 51/285; 51/246; 76/82

[58] Field of Search ..... 51/3, 92 BS, 98 BS, 51/102, 170 R, 170 PT, 205 WG, 208, 210, 241 S, 246, 247, 285; 76/82, 82.1, 82.2, 83, 84, 86, 88, 89

[56] References Cited

U.S. PATENT DOCUMENTS

| | | | |
|---|---|---|---|
| 1,324,512 | 12/1919 | Maurer | 51/214 X |
| 2,092,443 | 9/1937 | Crossley | 51/214 X |
| 2,524,332 | 10/1950 | Sichel | 51/241 S |
| 3,036,408 | 5/1962 | Hansen | 51/285 X |
| 3,164,932 | 1/1965 | Morith | 51/170 PT |
| 3,841,030 | 10/1974 | Laszlo | 51/102 X |
| 3,875,825 | 4/1975 | Buttafuoco | 76/88 X |
| 4,630,409 | 12/1986 | Hofstetter | 76/88 X |
| 4,665,778 | 5/1987 | Lubin et al. | 76/83 |

*Primary Examiner*—Robert P. Olszewski

*Attorney, Agent, or Firm*—Richard C. Litman

[57] ABSTRACT

A veneer lathe knife and clipper knife honing device including a carriage member resting substantially on a lathe knife cutting edge that is itself upturned to receive the device. A plurality of guiding members and honing members are deployed on a compound coplanar surface of the carriage member so as to guide and hone the lathe knife cutting edge as the carriage member is propelled or pushed across the cutting edge by handle gripping members affixed to the carriage member. The advantage and unique quality of the present invention is in its honing to within close tolerances a specific bevel cutting action that results directly from the co-planar surfaces on the carriage member, the coplanar surfaces defining therebetween a bevel, which orients a plurality of honing and grinding members to impact a correct sharpening action to the lathe knife or clipper knife cutting edge.

18 Claims, 2 Drawing Sheets

VENEER LATHE KNIFE HONING DEVICE

CROSS-REFERENCE TO RELATED APPLICATION

The present application is a continuation in part of previous application Ser. No. 07/ 100,247 filed Sept. 23, 1987, now abandoned.

FIELD OF THE INVENTION

The present invention is an improvement on devices to keep lathe knives and clipper knives sharpened and more particularly to sharpen those knife blades that are in the manufacture of plywood and other veneer products.

BACKGROUND OF THE INVENTION

One of the initial steps in the manufacture of plywood and other veneer products requires peeling logs into sheet like strips. This is done by axially rotating the logs against a special cutting apparatus, a lathe knife. The cutting edge of the lathe knife is typically upturned to receive a log that is biased against the knife for the peeling operation.

The lathe knife faces upward and is positioned to present its cutting edge to the log. Machine operators and maintenance personnel are called upon to keep the blade in a sharpened condition. Typically, lathe knives are honed, on the machine, on both the face and back side each hour or two. The knife is back beveled once or twice daily, at the discretion of the operator. The lathe knife can be in excess of ten feet in length. It is very difficult to maintain an accurate bevel angle along the full length of the cutting edge with currently available hand tools. Many cut hands result from operators using hand held stones and files.

Clipper knives are similar to lathe knives with respect to sharpness required and length but face downward. Typically clipper knives are positioned at an angle that makes it very awkward for operators to sharpen them with hand held stones. This procedure (honing) is required approximately once each week. Many equipment operators are reluctant to perform the sharpening function because of the difficult access. This invention greatly reduces the difficulty operators experience when honing a clipper knife.

This present invention relates to improvements in the apparatus and method by which lathe knives and clipper knives are kept in a sharpened condition. This invention allows even the most inexperienced operator to maintain exact bevel angles while honing a knife to a quality cutting edge. In the industry today it is the standard practice to sharpen both the lathe and clipper knives by a stone hand-held by the operator and manually moved across the blade to be sharpened. Considerable experience and skill is required to properly sharpen the knife and obtain good quality cutting results by this standard method.

This invention relates to an improved means for honing a knife to a quality edge that is not possible With hand-held stones and files. The invention will eliminate routine hand back-bevel filing, except for nick repairs. The invention will reduce by approximately seventy-five percent the amount of hand filing required by the current standard sharpening method.

This device further relates to a method of promoting a higher quality peel on veneer lathes and also to increasing the life of the knives while simultaneously providing a safer method for honing and back-bevel filing a knife.

SUMMARY OF THE PRIOR ART

The following U.S. Patents are representative of the prior art and are found to be exemplary of those devices, both patented and unpatented, for sharpening lathe knives and clipper knives.

They are:

| U.S. Pat. No. | Inventor |
|---|---|
| 2,092,443 | Crossley |
| 3,164,932 | Morith |
| 1,324,512 | Maurer |
| 4,630,409 | Hofstetter |
| 3,875,825 | Buttafuoco |

U.S. Pat. No. 2,092,442, issued to Crossley, discloses a tool for sharpening knives with scalloped edges. This device consists of an abrading member carried by a holder in which the abrading member is triangularly shaped and is mounted so that it can have a slight rocking movement.

U.S. Pat. No. 3,164,932, to Morith, discloses an ice skate sharpener in which power rotates a grinding surface while the tool is moved across of the blade by a handle.

U.S. Pat. No. 1,324,512, issued to Maurer, discloses a knife sharpener having graduated sharpening surfaces from coarse to fine.

U.S. Pat. No. 4,630,409, issued to Hofstetter, discloses a device for finishing the edges of skis. This apparatus teaches the use of two pairs of opposing roller guides.

U.S. Pat. No. 3,875,825, to Buttafuoco, discloses a ski sharpener which has sharpening blades mounted in a yoke to be spring biased toward the workpiece.

SUMMARY OF THE INVENTION

An object of the present device is to provide a means for accurately filing and honing lathe knives and clipper knives to improve the quality of the cutting edge to a degree not possible with hand-held stones and files.

Another object of the present apparatus is to provide a safer means for personnel to efficiently and accurately file and hone a lathe knife and clipper knife promoting a higher quality peel on veneer lathes, while eliminating hand filing, except for nick repair and thereby reduce monthly hand filing costs for both labor and materials by approximately seventy five percent.

A further object is to provide an adjustable mechanism by which the device maintains exact preset bevel angles, which is one of the primary requirements in maintaining a knife to perfect cutting edge. Accordingly, this further object is to provide a device for ease of use, safety in use, while imparting to the knife cutting edge an exact bevel that is preset through a device adjustment.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT

Figure 1:
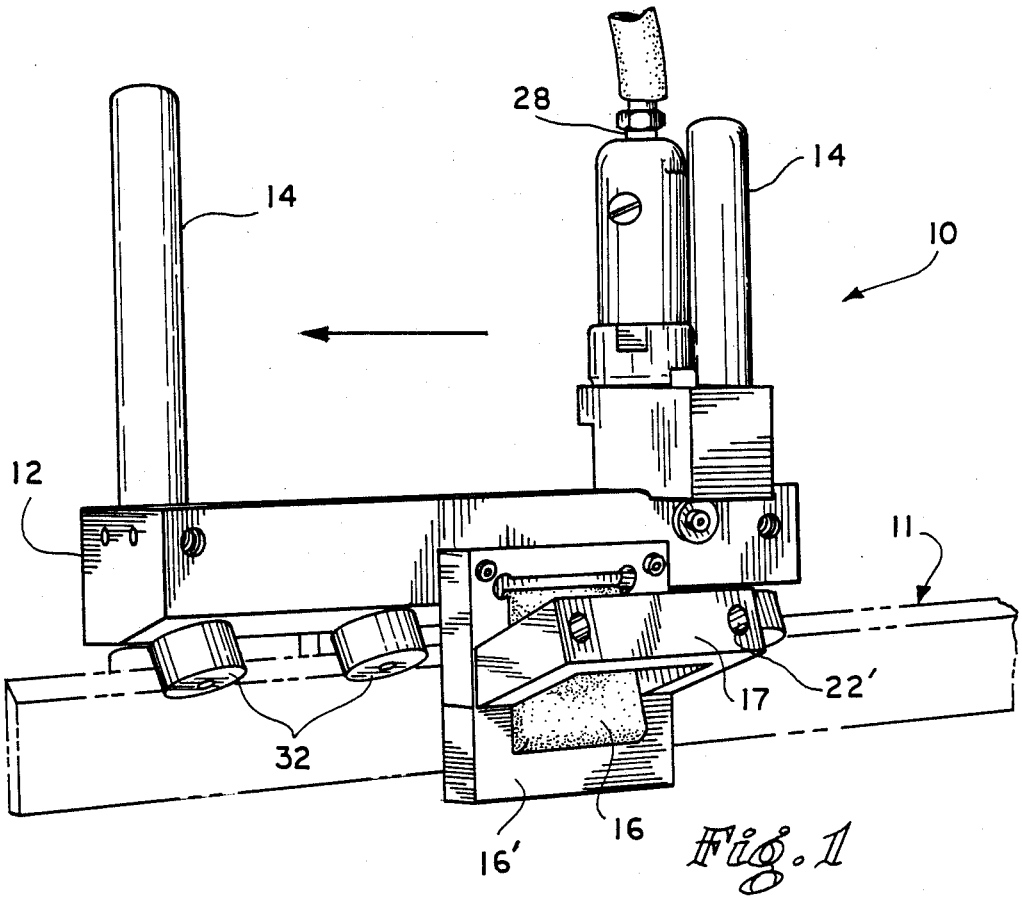
FIG. 1 is an elevational view of the device as mounted atop a lathe knife prior to an operator sliding or moving the device along the upturned cutting edge of the knife.
Figure 2:
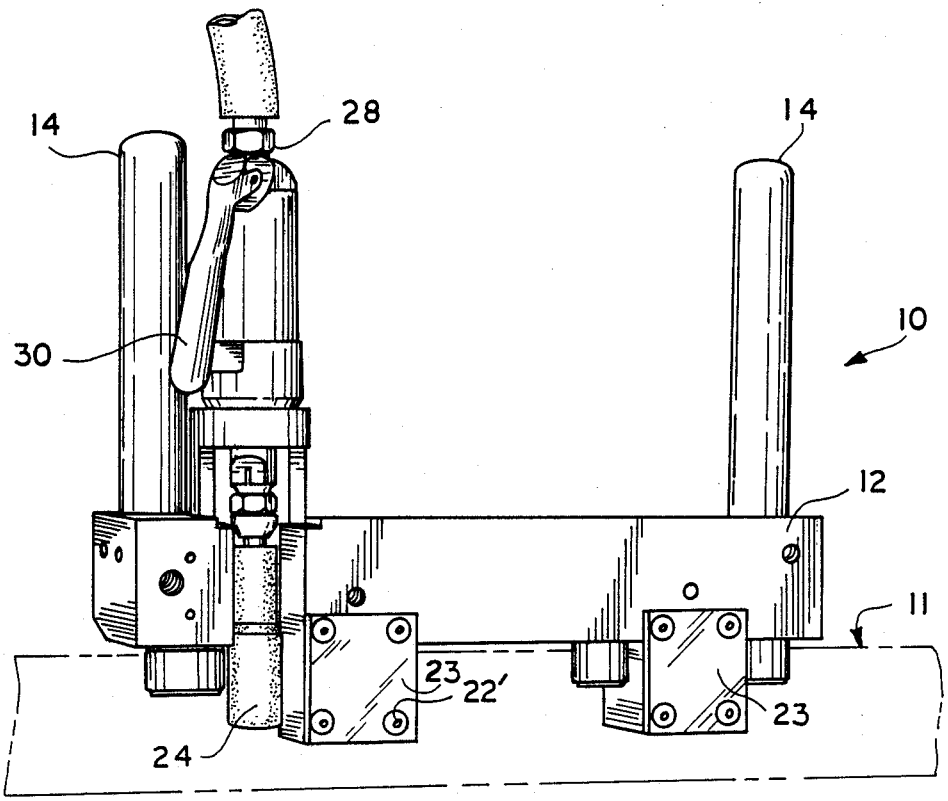
FIG. 2 is a perspective view of the device illustrating a plurality of guiding means, and a first and second honing means, and a means for grinding the cutting edge of the knife blade.
Figure 3:
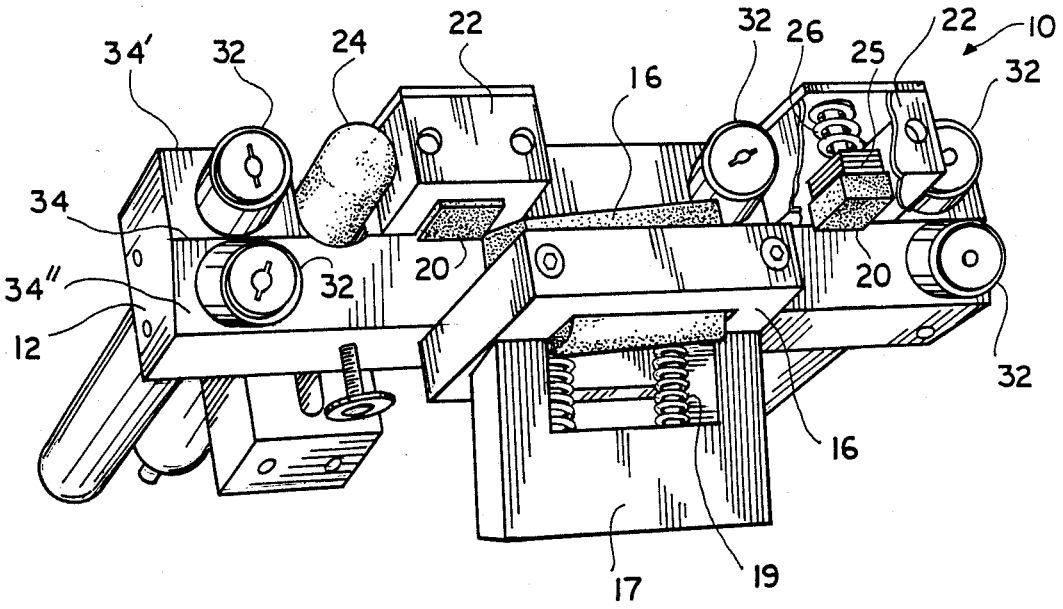
FIG. 3 is an exploded view of the carriage member and illustrates the principle elements which are attached to the carriage member.

Referring now to FIGS. 1 through 3, device 10 has a carriage member 12 having a plurality of gripping means or handles 14 vertically disposed thereon. Handles 14 are mounted atop carriage element 12.

Carriage element 12 has coplanar surfaces 34' and 34" forming an edge 34 that is placed substantially in contact with an upturned, vertically disposed, cutting edge 11 of a lathe knife or clipper knife.

Coplanar surfaces 34' and 34" each have arrayed thereon a plurality of guiding means 32 rotatably affixed to their respective surfaces and arranged in pairs, each element or roller means thereof deployed on its respective surface so that an angle is created tangential to their direction of rotation.

As device 10 is placed atop a lathe knife or clipper knife that is to be sharpened, the cutting edge 11 of the knife is disposed upwardly, within the confines as defined by the sides of roller means 32 and further, the knife is held or guided within the apparatus proximate to edge 34.

By means of rollers 32 the device 10 is stabilized atop a knife to be sharpened and guiding means 32 aligns the device as it is propelled or moved along the cutting edge 11 of the knife. As the device is slid along the cutting edge 11 a first and a second honing means is deployed along the sides of the knife's cutting edge 11 to impact a filing or honing thereto.

First honing means 16 is deployed free floating within a structural yoke member 16' that has means for urging or biasing a first honing stone against the side of the knife's cutting edge 11 as the device is propelled along the cutting edge 11. Auxiliary member 17 functions to anchor a spring mechanism 19 on one end thereof while the other end of spring mechanism 19 is attached to an anterior or rear wall of structural yoke member 16' so that as the knife cutting edge 11 is brought into proximity with first honing means 16, the honing action imparts a bevel angle to the cutting edge 11 that results in a correct hone to the metal. The honing stones used can be rounded or rectangular and of varying sizes.

A plurality of second honing means 20 are contained with a plurality of auxiliary structural yoke members 22 that are pre-adjusted to a pre-set bevel angle between zero and fortyfive degrees when the device 10 is manufactured. Operators are thus prevented from adjusting the bevel angle. The rear plate 23 of yoke members 22 are sealed by fasteners 22'. Second honing means 20 are also spring 26 biased in the yoke members 22 similar to the way honing means 16 is spring biased. The spring tension of both honing elements 16 and 20 can be adjusted by the addition or removal of shim washers 25 placed behind the stones as the stones wear down to maintain a consistent pressure on the knife blade. In the device 10 the number and placement of the stones 16 and 20 can be varied to meet the exact requirements of a task.

Pneumatically actuated grinding means 24 can be mounted within a concave recess in carriage member 12 so that as the cylindrical grinder 24 is actuated by an operator depressing lever 30, high pressure air is valved through pneumatic coupling means 28, causing grinder means 24 to rotate. This has the double effect of creating a back-bevel on the lathe knife and, when desired, on the clipper knife and also assisting in propelling the device 10 along the upturned cutting edge 11 of the blade during the backbeveling process. Of course such an air grinding device may be left optional and the honer may just consist of the honing stones 16,20,20, rollers 32 and the other additional features described above.

Figure 4:
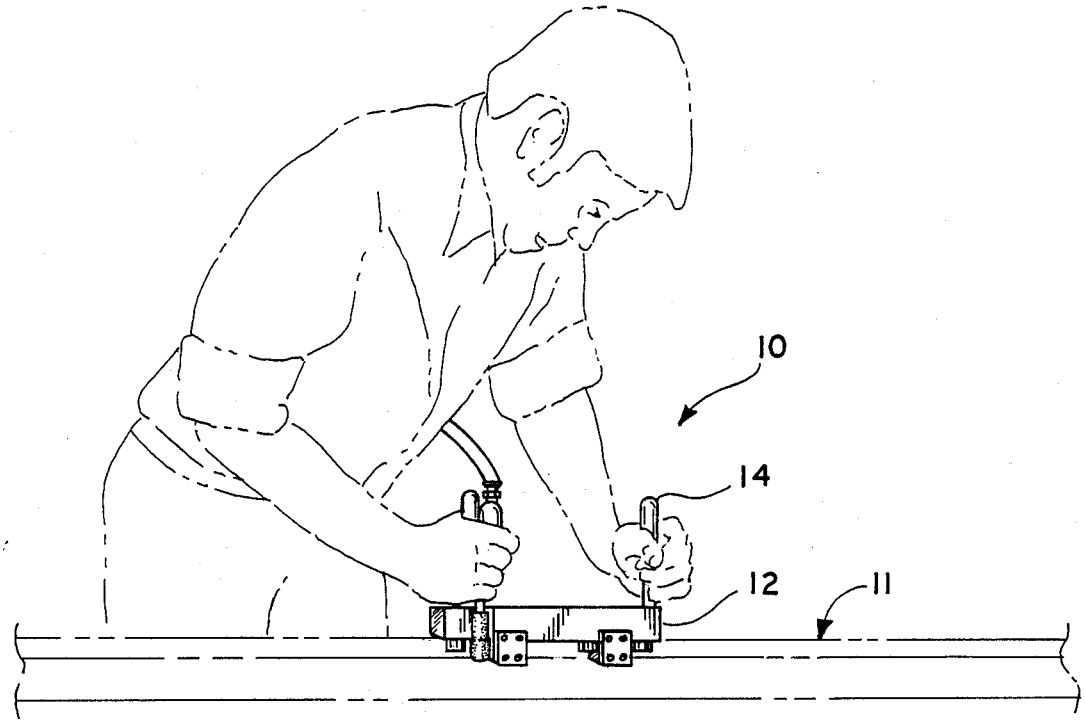
FIG. 4 is a view showing the device of the present invention in use.

In use, as shown in FIG. 4, an operator or user grips the handles 14, places the apparatus on a cutting edge 11 to be sharpened, and controls the device by moving it along the cutting edge 11. When back-bevel grinding is desired, pneumatic control lever 30 (FIG. 2) is actuated.

The foregoing is considered as illustrative only of the principles of the invention. Further, since numerous modifications and changes will readily occur to those skilled in the art, such as the exact number, size and placement of the stones, it is not desired to limit the invention to the exact construction shown and described, and accordingly, all suitable modifications, and equivalents which may be resorted to, fall within the scope of the invention.

What is claimed is:

1. A veneer lathe knife honing device, comprising:

a carriage member having a plurality of gripping means for manually moving and the carriage member along a veneer lathe knife a plurality of coplanar surfaces that form a beveled edge that is substantially deployed in opposing contact with a veneer lathe knife cutting edge that is to be sharpened;

said carriage coplanar surfaces have each arrayed thereon a plurality of guiding means substantially urging said veneer lathe knife cutting edge against a plurality of honing means mounted on the carriage member;

said guiding means comprising a plurality of roller means arrayed in pairs, each element in a pair thereof being opposingly positioned on a respective coplanar surface so that said beveled edge is disposed therebetween whereby said veneer lathe knife cutting edge is disposed between said elements of said roller means.

2. A lathe knife honing device as recited in claim 1, including a grinding means having means for actuation thereon, said grinding means deployed within said carriage member so that as said guiding means urge said veneer lathe knife cutting edge against said honing means, said guiding means progressively urge said lathe knife cutting edge against said grinding means whereby as said gripping means are used to propel said carriage member over said lathe knife cutting edge, said plurality of honing means and said grinding means provide action for sharpening of same.

3. A lathe knife honing device as recited in claim 2, wherein said grinding means is manually and pneumatically propelled.

4. A lathe knife honing device as recited in claim 1, wherein said honing means includes at least one first honing means contained within a structural yoke member, said structural yoke having means for biasing said first honing means against said lathe knife cutting edge.

5. A lathe knife honing device as recited in claim 4, wherein said honing means includes at least one second honing means contained within a structural yoke member, said structural yoke member having means for biasing said second honing means against said lathe knife cutting edge.

6. A lathe knife honing device as recited in claim 4 wherein said structural yoke members are secured by fastening means to said carriage member.

7. A lathe knife honing device as recited in claim 5, wherein said structural yoke members are secured by fastening means to said carriage member.

8. A lathe knife honing device as recited in claim 6, wherein said fastening means is threaded fasteners.

9. A lathe knife honing device as recited in claim 7, wherein said fastening means is threaded fasteners.

10. A lathe knife honing device as recited in claim 4, wherein said means for biasing said first honing means against a said lathe knife cutting edge is a spring biased mechanism.

11. A lathe knife honing device as recited in claim 10, wherein said spring biased mechanism is anteriorly positioned in respect to said structural yoke member.

12. A lathe knife honing device as recited in claim 5, wherein said means for biasing said second honing means against a said lathe knife cutting edge is a spring biased mechanism.

13. A lathe knife honing device as recited in claim 1, wherein said coplanar surfaces are constructed to impart an angle to said honing means that subsequently imparts a bevel angle to said lathe knife cutting edge.

14. A lathe knife honing device as recited in claim 1, wherein said plurality of honing means comprises first and second honing means, said second honing means is a pair of honing stones each respectively contained within a structural yoke member, each said honing stone being opposingly deployed about a first honing means, said first honing means being deployed therebetween.

15. A lathe knife honing device as recited in claim 1 wherein said gripping means comprises a pair of vertically disposed handles, said handles being affixed to said carriage member.

16. A lathe knife honing device as recited in claim 1, wherein said honing means have means for selectively adjusting same.

17. A lathe knife honing device as recited in claim 16, wherein said adjusting means comprises shim washers placed behind said honing stones.

18. A lathe knife honing device as recited in claim 2, wherein said grinding means is substantially deployed within a concaval recess within said carriage means.

* * * * *